US008229074B2

(12) United States Patent
Mahapatra

(10) Patent No.: US 8,229,074 B2
(45) Date of Patent: Jul. 24, 2012

(54) CARBON NANOTUBE ARRAY FOR FOCUSED FIELD EMISSION

(75) Inventor: Debiprosad Roy Mahapatra, Karnataka (IN)

(73) Assignee: Indian Institute of Science (IN)

( * ) Notice: Subject to any disclaimer, the term of this patent is extended or adjusted under 35 U.S.C. 154(b) by 266 days.

(21) Appl. No.: 12/620,990

(22) Filed: Nov. 18, 2009

(65) Prior Publication Data

US 2011/0038465 A1 Feb. 17, 2011

(30) Foreign Application Priority Data

Aug. 17, 2009 (IN) ..... 1945/CHE/2009

(51) Int. Cl.
*H01J 35/06* (2006.01)

(52) U.S. Cl. ..... 378/122; 378/138

(58) Field of Classification Search ..... None
See application file for complete search history.

(56) References Cited

U.S. PATENT DOCUMENTS

| | | | | |
|---|---|---|---|---|
| 7,049,739 | B2 | 5/2006 | Jin et al. | |
| 2006/0163994 | A1* | 7/2006 | Damen | 313/309 |
| 2006/0274889 | A1* | 12/2006 | Lu et al. | 378/122 |
| 2007/0261140 | A1* | 11/2007 | Liang | 977/876 |
| 2008/0018228 | A1* | 1/2008 | Choi et al. | 313/497 |

FOREIGN PATENT DOCUMENTS

JP 2008-041539 2/2008

OTHER PUBLICATIONS

International Search Report and Written Opinion issued by the Australian Patent Office in PCT/IB2010/053611, dated Dec. 7, 2010.

Fowler, R., H., et al., "Electron Emission in Intense Electric Field," Proceedings of the Royal Society of London, Series A, Containing Papers of a Mathematical and Physical Character, Mar. 31, 1928, vol. 119, Issue 781, pp. 173-181.

Lijima, S., "Helical Microtubules of Graphitic Carbon," Letters to Nature, Nov. 7, 1991, vol. 354, pp. 56-58.

Nilsson, L., et al., "Scanning field emission from patterned carbon nanotube films," Applied Physics Letters, 2000, vol. 76, pp. 2071-2073.

Sinha, N., et al., "Carbon Nanotube Thin Film Field Emitting Diode: Understanding the System Response Based on Multiphysics Modeling," Journal of Computational and Theoretical Nanoscience, 2007, vol. 4, No. 3, pp. 1-15.

Sinha, N., et al., "Characterization of Self-Assembly and Evolution in Carbon Nanotube Thin Film Field Emitter," Proceedings of the 6th IEEE Conference on Nanotechnology, Cincinnati, USA, Jul. 16-20, 2006, pp. 673-676.

(Continued)

*Primary Examiner* — Hoon Song
(74) *Attorney, Agent, or Firm* — McDonnell Boehnen Hulbert & Berghoff LLP

(57) ABSTRACT

Systems and methods are provided for field emission device. An array of carbon nanotubes is arranged in a variable height distribution over a cathode substrate. An anode is provided to accelerate the emitted electrons toward an x-ray plate. Voltage is supplied across the array of carbon nanotubes to cause emission of electrons. The pointed height distribution may be linear or parabolic, and a peak height of the variable height distribution may occur in a center of the array. A side gate may also be provided adjacent the array of carbon nanotubes to provide improved electron emission and focusing control.

15 Claims, 7 Drawing Sheets

OTHER PUBLICATIONS

Sinha, et al., "Multi-Mode Phonon Controlled Field Emission from Carbon Nanotubes: Modeling and Experiments," Proceedings of the 7th IEEE International Conference on Nanotechnology, Hong Kong, Aug. 2-5, 2007, pp. 961-964.

Svizhenko, et al., "Ballistic Transport and Electrostatics in Metallic Carbon Nanotubes," IEEE Transactions on Nanotechnology, Sep. 2005, vol. 4, Issue 5, pp. 557-562.

Huang, Z. P., et al., "Field Emission of Carbon Nanotubes," Encyclopedia of Nanoscience and Nanotechnology, 2004, vol. 3, pp. 401-416.

Mahapatra, D. R., et al., "Design Optimization of Field Emission From a Stacked Carbon Nanotube Array," NSTI-Nanotech 2008, pp. 55-58.

Sinha, N., et al., "Electromechanical interactions in a carbon nanotube based thin film field emitting diode," Nanotechnology, 2008, vol. 19, pp. 1-12.

Mahapatra, D. R., et al., "Enhancing Field Emission from a Carbon Nanotube Array by Lateral Control of Electrodynamic Force Field," Molecular Simulation, vol. 35, No. 65, May 2009, 512-519.

* cited by examiner

CARBON NANOTUBE ARRAY FOR FOCUSED FIELD EMISSION

CROSS REFERENCE TO RELATED APPLICATIONS

This application claims priority to Indian Patent Application Serial No. 1945/CHE/2009 filed Aug. 17, 2009, the contents of which are incorporated by reference herein in its entirety.

TECHNICAL FIELD

This application relates generally to a carbon nanotube array for focused field emissions.

BACKGROUND

Miniaturized products have become increasingly dominant in the medical field. The benefits of having smaller components include ease of movement, reduced packaging and shipping costs, reduced power consumption, and fewer problems with thermal distortion and vibration. In light of these advantages, miniaturization of systems and devices has become an active area of research. In the past decade, enormous progress has been made in developing new fabrication techniques and materials for developing smaller biomedical devices. One promising area of research that could provide for substantial miniaturization of devices involves the use of carbon nanotubes.

Carbon nanotubes exhibit impressive structural, mechanical, and electronic properties in a small package, including higher strength and higher electrical and thermal conductivity. Carbon nanotubes are essentially hexagonal networks of carbon atoms and can be thought of as a layer of graphite rolled up into a cylindrical shape.

Techniques being used for producing carbon nanotubes include 1) a carbon arc-discharge technique, 2) a laser-ablation technique, 3) a chemical vapor deposition (CVD) technique, and 4) a high pressure carbon monoxide technique.

Before the advent of carbon nanotubes, the traditional method of generating x-rays comprised the use of a metallic filament (cathode) that acts as a source of electrons when heated to a very high temperature. Electrons emitted from the heated filament are then bombarded against a metal target (anode) to generate x-rays.

Research has reported, however, that field emission may be a better mechanism of extracting electrons compared to thermoionic emission. In field emission, the electrons are emitted at room temperature and the output current is voltage controllable. In addition, the voltage necessary for electron emission is lowered.

SUMMARY

In accordance with one embodiment, a field emission device includes a cathode, the cathode having a substrate and an array of carbon nanotubes arranged over the substrate in a variable height distribution wherein the variable height distribution progresses from an edge to a center of the distribution. The variable height distribution has a linear progression from an edge to a center of the distribution. The field emission device may also include a side gate arranged adjacent the array in a partially overlapping manner such that at least a portion of the side gate exists in a same plane as at least a portion of the array of carbon nanotubes. The side gate may circumferentially surround the array of carbon nanotubes. For use in an x-ray imager or dosing device, the field emission device may further include an x-ray plate disposed over the cathode and array of carbon nanotubes. The x-ray plate may be formed of a material that, when struck by electrons emitted from the array of carbon nanotubes, produces x-rays.

In another embodiment, an imaging device may include an array of pixels, each pixel including a field emission device, and each field emission device including a cathode, the cathode having a substrate and an array of carbon nanotubes arranged over the substrate in a variable height distribution.

In a further embodiment, a method of focusing field emission in a field emission device includes supplying a voltage across an array of carbon nanotubes arranged over a cathode substrate, wherein the array is configured to have a pointed height distribution wherein the variable height distribution progresses from an edge to a center of the distribution.

In another embodiment, a method of focusing field emission in a field emission device includes supplying a voltage across an array of carbon nanotubes arranged over a cathode substrate, wherein the array of carbon nanotubes is configured such that an average height of carbon nanotubes increases from a circumferential position of the cathode substrate to a central position of the cathode substrate, with a maximum average height of carbon nanotubes occurring at substantially a center of the cathode substrate.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE FIGURES

FIG. 6(*b*) is a simulated plot of initial and deflected shape of an array of carbon nanotubes at t=50 s of field emission for a random height distribution of a comparative example.

FIG. 7(*b*) is a plot illustrating simulated tip deflection angles of carbon nanotubes in an array of 100 carbon nanotubes at t=50 s of field emission for a random configurations of a comparative example.

FIG. 9(*b*) is a plot illustrating simulated time history of field emission current density for an array of 100 CNTs at t=50 s of field emission for a random height distribution of a comparative example.

FIG. 11(*b*) is a plot illustrating simulated maximum temperatures at the tips of the carbon nanotubes for an array of 100 CNTs at t=50 s of field emission for a random height distribution of a comparative example.

DETAILED DESCRIPTION

Figure 1:
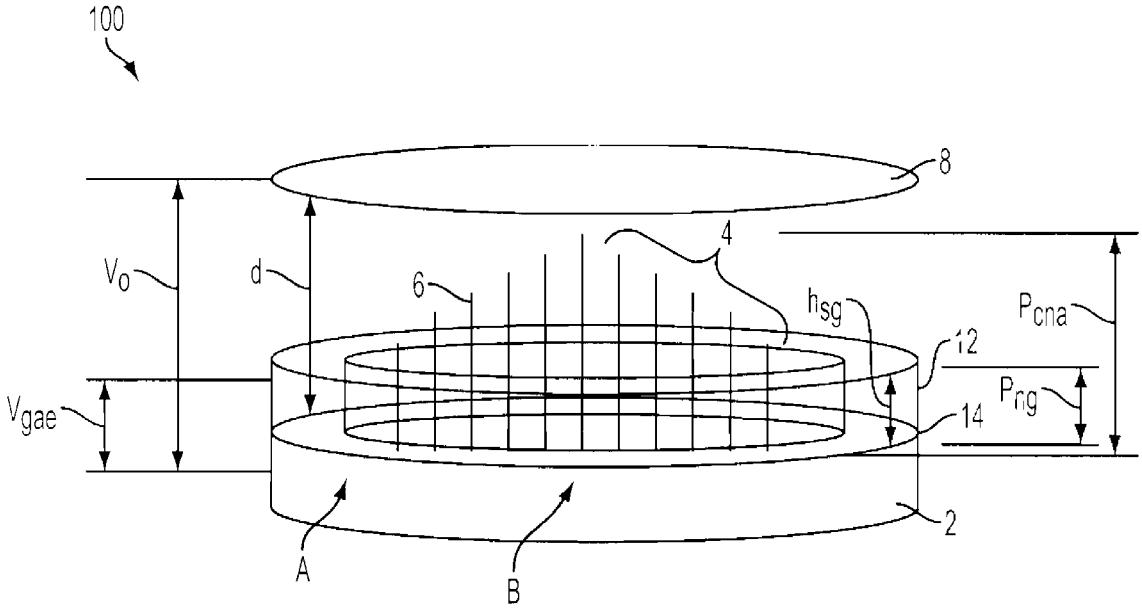
FIG. 1 is a perspective view of an x-ray emitting source device including a field emitter according to one embodiment of the disclosure.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated and make part of this disclosure.

FIG. 1 illustrates an x-ray generation source 100 as a single pixel according to one embodiment. Carbon nanotubes grown on substrates may be used as electron sources in field emission applications. Carbon nanotube arrays can be grown on cathode substrates and their collective dynamics utilized such that the total emission intensity of the array is sufficiently high while the reduced load on each carbon nanotube can lead to longer operational life of the imaging device. Such arrays can advantageously be used in forming nano-scale x-ray imaging and/or x-ray delivery devices, of which an x-ray generation source is a critical element. X-ray imaging devices include, for example, skeletal imagers for imaging bone structures of mammals. X-ray delivery devices include, for example, targeted radiation therapy devices used as part of a cancer treatment plan to control further growth of malignant cells.

As shown in FIG. 1, the x-ray generation source 100 may include a cathode substrate 2, a carbon nanotube array 4 of carbon nanotubes 6, an anode 8, a side-gate 12, and an optional insulating layer 14 between the substrate 2 and the side gate 12. Although FIG. 1 shows a single pixel comprised of a single x-ray generation source 100, an x-ray generation source in practice may include a plurality of pixels in a one, two, or three-dimensional array.

The cathode substrate 2 of the x-ray generation source 100 supports the cathode array 4 and provides a growth surface for the carbon nanotubes 6. Substrate materials onto which carbon nanotubes 6 can be grown include, for example, aluminum, copper, stainless steel, molybdenum, silicon, quartz, mica, or highly oriented pyrolytic graphite (HOPG). Other materials can also be used. The cathode substrate 2 may be cylindrically shaped as shown in FIG. 1, or may have any other shape, including for example, square or polynomial. The cathode substrate material may also provide rigid support for the cathode nanotube array 4.

The cathode nanotube array 4 is formed over the cathode substrate 2. While FIG. 1 illustrates the carbon nanotubes 6 being formed directly on the substrate 2, one or more layers could be formed between the substrate 2 and the cathode nanotube array 4. The carbon nanotubes 6 forming the array can be grown as single-wall nanotubes (SWNTs) or multi-wall nanotubes (MWNTs).

Most SWNTs have a diameter of close to 1 nanometer, with a tube length that can be many thousands of times longer. The structure of a SWNT can be conceptualized by wrapping a one-atom-thick layer of graphite called graphene into a seamless cylinder.

MWNTs consist of multiple layers of graphite rolled in on themselves to form a tube shape. The MWNT can be formed in two ways. In a first model, sheets of graphite are arranged in concentric cylinders, e.g., a SWNT within a larger SWNT nanotube. In a second model, a single sheet of graphite is rolled in around itself, resembling a rolled newspaper. The interlayer distance in multi-walled nanotubes is close to the distance between graphene layers in graphite, approximately 3.3 Å (330 pm).

The carbon nanotubes 6 could be uniformly oriented or randomly oriented, although a uniform orientation is preferred. Any number of carbon nanotube growth processes can be used to form the nanotube array, including, for example, laser ablation, arc discharge, or chemical vapor deposition. Other growth processes could also be used. The carbon nanotubes 6 could have an armchair structure, a zigzag structure, a chiral structure, or any other structure.

The carbon nanotubes 6 may also have atomic defects or doping by one or more different atomic species. For example, the carbon nanotubes 6 may be doped with boron, boron nitride, copper, molybdenum, or cobalt. The doping of the carbon nanotubes 6 may provide for enhanced electron emission efficiency. All the carbon nanotubes 6 may be doped with a similar impurity at a similar dose, or the doping and/or impurity may vary across the array 4 of carbon nanotubes 6.

The anode 8 is offset axially a distance d from the cathode substrate 2. The anode 8 may be formed of a conductive metal, such as copper. An electric field is formed between the cathode substrate 2 and the anode 8 by application of a voltage $V_0$ between the anode 8 and the cathode substrate 2.

The electrons flow best when the nanotubes are placed vertically on the cathode substrate and then a potential difference is applied between the bottom edge of the tube and the anode which at some distance ahead of the other end of the tube (tip of the tube). Between the anode and the other end of the tube, the free space enhances the ejection of the electrons ballistically from the tube tip.

The applied electric field accelerates the electrons emitted from the carbon nanotube array 4 in an axial direction towards the anode 8. Other anode materials and structures could also be used. For example, the anode 8 may be formed as a mesh structure.

In certain applications, an x-ray plate (not shown) may be formed above the anode 8 and of a material that, when impacted by the electrons emitted from the carbon nanotube array 4 and accelerated by the anode 8, produces x-rays. For example, copper (Cu) or molybdenum (Mo) could be used. Other materials could also be used. The x-ray plate may be angled off-axis in order to direct x-rays produced by the x-ray plate in an angular direction offset from the axial direction in which the cathode substrate 2 and anode 8 are arranged.

Figure 2:
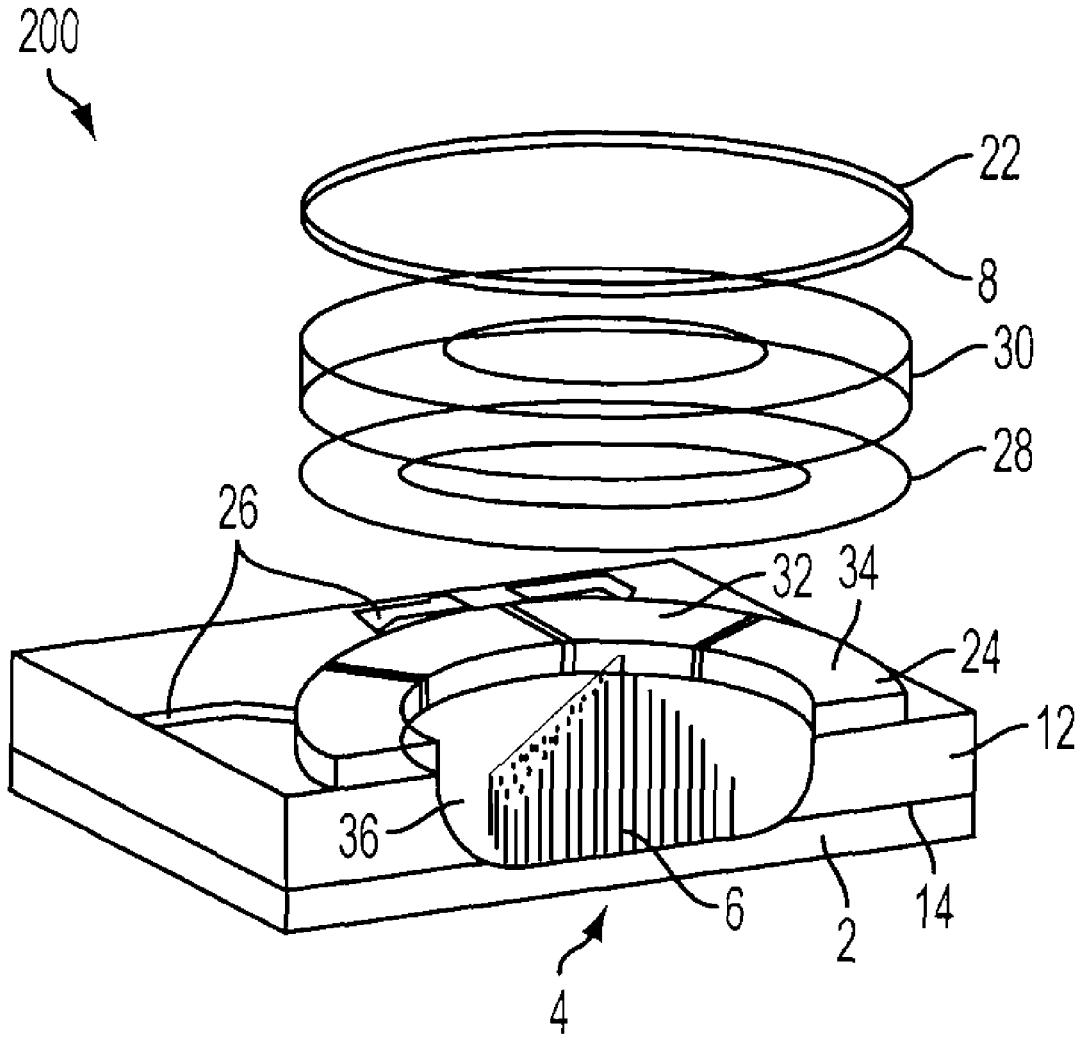
FIG. 2 is a perspective view of an x-ray emitting source device including a field emitter according to another embodiment of the disclosure.

FIG. 2 illustrates an alternative embodiment of the x-ray source generator 200. As shown in the exploded-view of FIG. 2, the nanotube array 4 may be housed in a sealed container closed off by the side-gate 12 and beryllium (Be) thin film window 22 in order to maintain a vacuum for improved operation of the x-ray source generator 200. For example, a vacuum in the range of from $10^{-3}$ to $10^{-9}$ bar could be used. The beryllium (Be) thin film window 22 may be provided at an upper-most surface of the sealed container to allow the generated x-rays to pass through, while maintaining the inside of the container in a vacuum state.

An additional MEMS-based beam control mechanism may also be included in the x-ray source generator 200. The MEMS-based beam control mechanism may include a first segmented side gate for beam control 24 formed over the side gate 12, metal electrodes 26 providing individual control to the segmented side gate 24, an insulation layer 28, and a second side gate for beam control 30 that may or may not be segmented. An additional insulating layer (not shown) may be formed to insulate the electrodes 26 from the underlying side gate 12. Alternatively, the need for an additional insulating layer could be eliminated by utilizing wide band gap semiconductors and metals.

The segmented side gate for beam control 24 can be utilized to homogenize the electron emissions from the nanotube array 4. The segmentation of the beam control 24 allows for precise control and re-direction of electrons emitted from the nanotube array 4. For example, in one instance, each one of the segments comprising the segmented beam control 24 could be provided a substantially similar voltage potential to center the electron emission through the beryllium window. Alternatively, due to a particular orientation of the nanotube array 4, or perhaps due to defects in the formation of the nanotube array, electron emissions tending to a particular quadrant may be re-directed. For example, electron emissions tending towards the ordinal north-east quadrant of the area within the segmented beam control 24 may be re-directed towards a center location by energizing the segments 32 and 34 in the north-east quadrant of the segmented beam control 24 at a higher voltage potential than the remaining segments in the segmented beam control 24.

Logic to control the segments of the segmented beam control 24 could be provided at each x-ray source generator 200, or could be placed at a peripheral location of an array of x-ray source generators, or even at an off-chip location. The logic may comprise hard-coded voltage potential application values determined at the time of manufacture or some time thereafter, or may comprise variable voltage potentials that may vary with respect to a detected location of the electron emissions, or may comprise a manually adjusted value adjusted by an operator of the device.

In addition to the segmented beam control 24, an additional segmented or non-segmented beam control ring 30 may be provided over the segmented beam control 24. The segmented beam control 24 is generally positioned so as to be in a same or proximate vertical plane as the maximum height of the nanotube array 4. In contrast, the additional beam control ring 30 is displaced in a direction of travel of the electron emissions at predetermined distance so as to provide an additional level of beam control prior to emission of the generated electrons through the beryllium window 22. Although not shown in FIG. 2, additional metal wiring(s) may be disposed in order to provide one or more voltage potentials to the additional beam control ring 30.

It is important to note that although the elements of FIG. 2 are shown generally having a circular shape, any other shape could be used, including, for example, a polygonal shape. Furthermore, the segmented beam control 24 could be formed by, for example, a masking and etching process, by a lithography process, or by a selective deposition process. Other processes could also be used.

The general method of producing electrons in the nanotube array 4 of either x-ray source generator 100 of FIG. 1 or x-ray source generator 200 of FIG. 2 does not substantially differ. Upon application of a voltage between the cathode substrate 2 and anode 8, the carbon nanotubes 6 begin to emit electrons, which are accelerated towards the anode 8 due to the direction of the applied electrical field between the anode 8 and the cathode 2.

The background electric field can be defined as $E=-V_0/d$, where $V_0=V_d-V_s$ is the applied bias voltage, $V_s$ is the constant source potential on the substrate side, $V_d$ is the drain potential on the anode side and d, as before, is the clearance between the electrodes. The total electrostatic energy consists of a linear drop due to the uniform background electric field and the potential energy due to the charges on the carbon nanotubes. Therefore, the total electrostatic energy can be expressed as $$v(x, z) = -eV_s - e(V_d - V_s)\frac{z}{d} + \sum_j G(i, j)(\hat{n}_j - n)$$

where e is the positive electronic charge, G(i, j) is the Green's function with i indicating the ring position and $\hat{n}_j$ describing the electron density at node position j on the ring. In the present case, while computing the Green's function, the nodal charges of the neighboring carbon nanotubes can also be considered. This essentially introduces non-local contributions due to the carbon nanotube distribution in the film. The total electric field $E(z)=-\nabla v(z)/e$ can be expressed as:

$$E_z = -\frac{1}{e}\frac{dv(z)}{dz}$$

The current density (J) due to field emission is obtained by using the Fowler-Nordheim (FN) equation:

$$J = \frac{BE_z^2}{\Phi}\exp\left[-\frac{C\Phi^{3/2}}{E_z}\right]$$

where $\Phi$ is the work function of the carbon nanotube, and B and C are constants. Computation is performed at every time step, followed by update of the geometry of the carbon nanotubes. As a result, the charge distribution among the carbon nanotubes also changes.

The field emission current ($I_{cell}$) from the anode surface corresponding to an elemental volume V, of the film of cathode substrate including carbon nanotubes and free space atop can then be obtained as:

$$I_{cell} = A_{cell}\sum_{j=1}^{N} J_j$$

where $A_{cell}$ is the anode surface area and N is the number of carbon nanotubes in the volume element. The total current is obtained by summing the cell-wise current ($I_{cell}$). This formulation takes into account the effect of carbon nanotube tip orientations.

Once the electrons are accelerated by the above-defined electric field and pass the anode 8, they impact the x-ray plate 10. The impact of the electrons on the material of the x-ray plate 10 causes x-rays to be emitted in a corresponding angle based, at least in part, on the impact angle of the electron and the tilt angle of the x-ray plate 10. Alternatively, or in addition, a crystal structure orientation of the x-ray plate 10 could be utilized to provide the angled emission of x-rays from the x-ray plate.

By arranging the carbon nanotubes 6 of the array 4 in a variable height distribution, as shown in either FIG. 1 or FIG. 2, a more focused beam of electrons is formed, and as a result, a more focused beam of x-rays is output. As shown in FIG. 1, an embodiment of variable height distribution includes a pointed height distribution where the average height of the carbon nanotubes 6 increases from a circumferential position "A" of the cathode substrate 2 to a central position "B" of the cathode substrate 2, with a maximum average carbon nanotube height at approximately the center position "B" of the cathode substrate 2. In such a pointed height distribution, the maximum average carbon nanotube height occurs substantially at the center of the array of nanotubes. While FIG. 1 shows a linear progression from the circumferential position to the center position, other progressions could be used, for example, parabolic or logarithmic. In any event, the distribution is preferably symmetric across a center region of the array.

Additionally, while FIG. 1 shows a single row of uniform carbon nanotubes 6, other arrangements may provide the same or similar benefits. For example, a two-dimensional array of carbon nanotubes 6 may be provided as shown in FIG. 2. A two-dimensional array of carbon nanotubes could take a pyramidal shape or a cone shape consistent with the requirement of a pointed height distribution. Similarly, although a generally linear progression is shown in FIG. 2, a non-linear progression could also be used including, for example, parabolic or logarithmic. Independent of the progression used in the 2-D array, preferably a maximum height of the array occurs at substantially a center of the 2-D array.

For either the one-dimensional of FIG. 1 or two-dimensional array of FIG. 2, a side-gate 12 may be disposed surrounding the nanotube array 4 in order to provide increased control over electron emission and focusing. As shown more clearly in FIG. 1, the side-gate 12 may be arranged in a same horizontal plane $P_{cna}$ as the carbon nanotube array 4. Although FIG. 1 shows the entire height $h_{sg}$ of the side-gate 12 overlapping the horizontal plane $P_{cna}$ defined by the carbon nanotube array 4, such a relationship is not required. For example, only a portion of a horizontal plane $P_{sg}$ defined by the height of the side-gate 12 need overlap a portion of the horizontal plane $P_{cna}$ defined by the height of the carbon nanotube array 4.

The side-gate 12 could be electrically shorted to the cathode substrate 2, or could be separated from the cathode substrate 2 via an intervening insulating layer 14. By providing an intervening insulating layer 14, a separate voltage difference $V_{gate}$ could be applied to the side-gate 12 in order to provide increased control over electron emission and focusing in the x-ray generation source 100.

As shown in FIG. 2, the side-gate 12 could circumferentially surround the carbon nanotube array 4. This could be accomplished by, for example, etching a grove 36 in a side gate layer and growing and/or depositing the nanotube array 4 in the formed grove 36. Alternatively, one or more stand-alone side-gate elements could be provided at discrete locations around the periphery of the carbon nanotube array 4.

Figure 3:
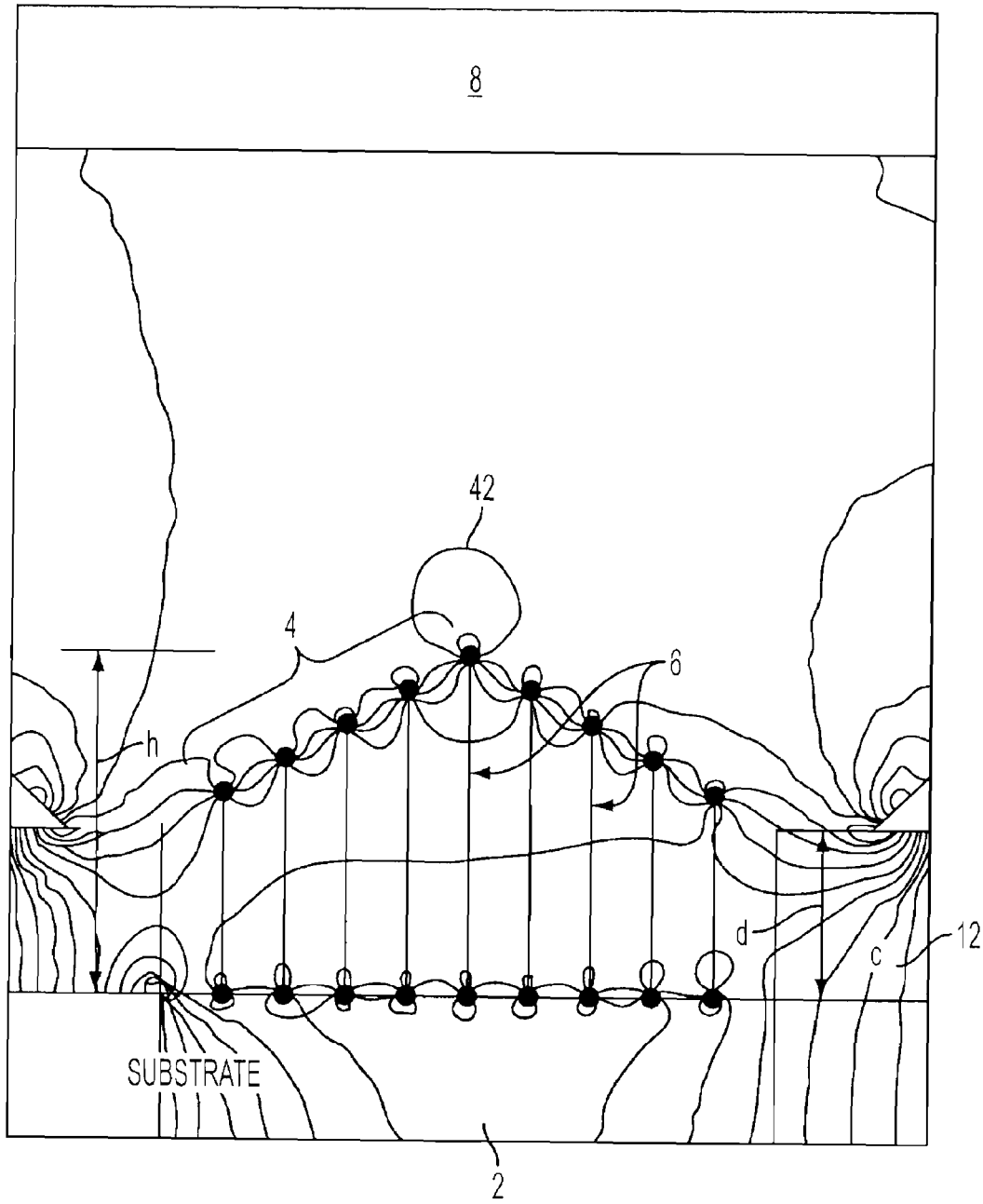
FIG. 3 a contour plot showing the concentration of the electric field surrounding the carbon nanotube tips arrayed as in the embodiment of FIG. 1.

FIG. 3 shows the transverse electric field distribution ($E_z$) 42 in the x-ray generation source of FIG. 1 with the side-gate 12 shorted to the cathode substrate 2 and with an application of a voltage $V_0$ of approximately 650 V between the anode 8 and cathode substrate 2. The distance h is the distance from the cathode substrate 2 to a peak height of a central carbon nanotube 6. The distance d is the distance from the cathode substrate 2 to a top of the side-gate 12. As can be seen in FIG. 3, the electric field generated is concentrated near the carbon nanotube tips under symmetric lateral force fields.

Several simulations were conducted utilizing a variable height distribution of the carbon nanotube array 4. During the simulations, the distance between the cathode substrate 2 and the anode surface 8 was taken as 34.7 μm. The height of the side-gate 12 was 6 μm, while the spacing between neighboring carbon nanotubes 6 in the array 4 was selected as 2 μm. A DC bias voltage $V_0$ of 650V was applied across the cathode substrate 2 and anode 8. Carbon nanotube 6 diameters and spacing, which effect carbon nanotube field emitter characteristics, were kept constant across these simulations.

Figure 4:
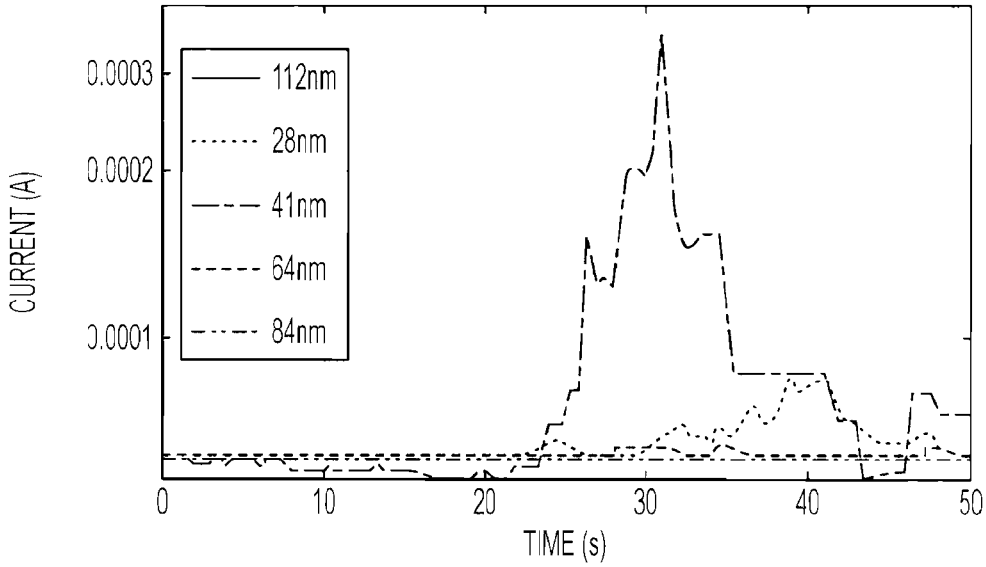
FIG. 4 is a plot illustrating simulated field emission current histories for varying diameters of carbon nanotubes under a DC voltage of 650V.
Figure 5:
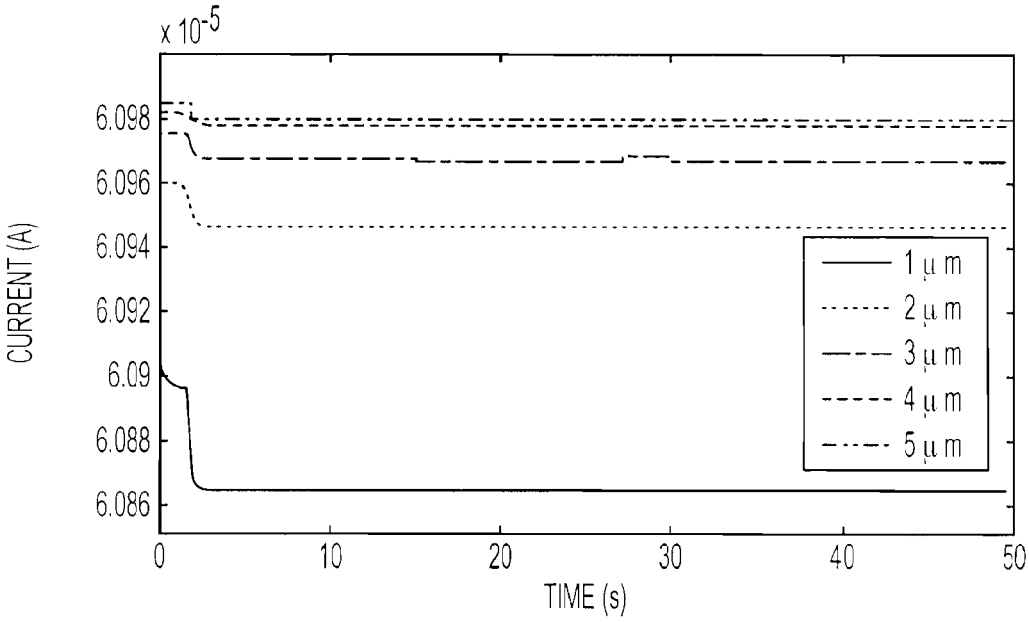
FIG. 5 is a plot illustrating simulated field emission current histories for varying spacing between neighboring carbon nanotubes under a DC voltage of 650V.

FIGS. 4 and 5 illustrate how diameter and spacing could affect field emission characteristics of the carbon nanotube array 4. FIGS. 4 and 5 specifically illustrate field emission current histories for two different parametric variations: diameter and spacing between carbon nanotubes 6 at the cathode substrate 2. In the first case, the spacing between neighboring carbon nanotubes 6 was kept constant, while the diameter was varied. The current histories for different values of diameters are shown in FIG. 4. As evident from the figure, the output current is low at large diameter values. This is due to the fact that current amplification is less with large diameter of carbon nanotubes 6 compared to small diameter carbon nanotubes.

In the second case, the diameter was kept constant, while the spacing between neighboring carbon nanotubes 6 was varied among 1 μm, 2 μm, 3 μm, 4 μm and 5 μm. The current histories for all these cases are shown in FIG. 5. The trends in five curves in FIG. 5 demonstrate that the current in all cases decreases initially and then becomes constant afterward and that as the spacing between neighboring carbon nanotubes increases, the output current increases. The results of FIGS. 4 and 5 can also be applied to the carbon nanotubes of the pointed height array, to obtain the desired current-voltage characteristics for a particular application by selectively choosing carbon nanotube diameters and spacing.

Figure 6A:
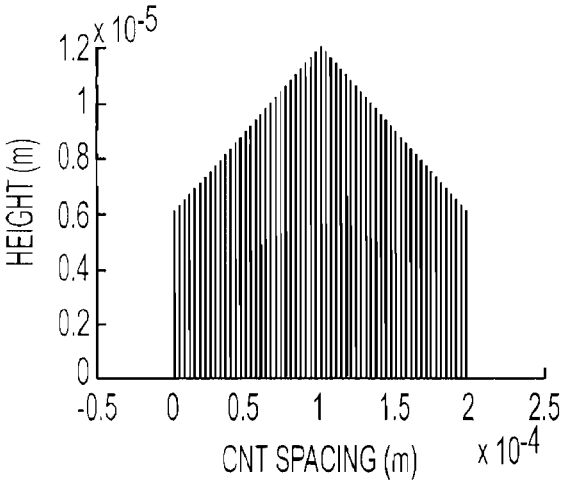
FIG. 6(*a*) is a simulated plot of initial and deflected shape of an array of carbon nanotubes at t=50 s of field emission for a height distribution according to an example embodiment of the invention.
Figure 6B:
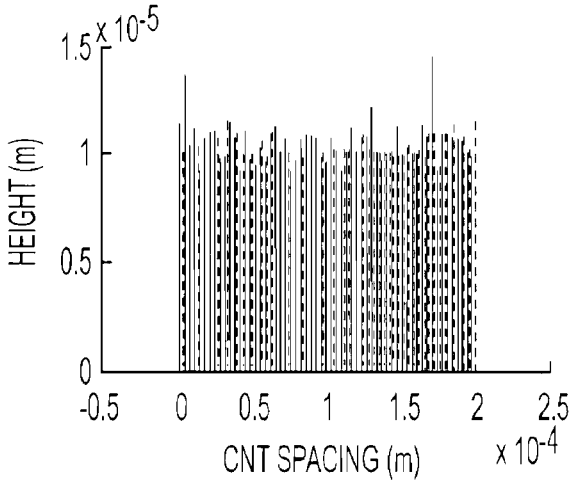

FIGS. 6(*a*) and 6(*b*) compare the deformation of carbon nanotubes in the pointed height distribution array configuration and the random height distribution array configuration. The solid lines illustrate an initial position and the dashed lines a final position approximately 50 s later. FIG. 6(*a*) illustrates the case where the carbon nanotubes are arranged in a pointed height distribution with heights varying from 6 μm at the edges to 12 μm at the center. FIG. 6(*b*) illustrates the case where the carbon nanotubes 6 are arranged in a randomly distributed array with heights varying as $h=(h_0\pm 2\ \mu m)\pm 2\ \mu m\times rand(1)$. Here the function rand denotes random number generator.

The deformation of carbon nanotubes during field emission is a combined effect of various electromechanical forces in a slow time scale and the fluctuation of the carbon nanotube sheet due to electron-phonon interaction in a fast time scale. Therefore, the total displacement $u_{total}$ can be expressed as:

$$u_{total}=u^{(1)}+u^{(2)}$$

where $u^{(1)}$ and $u^{(2)}$ are the displacements due to electromechanical forces and fluctuation of carbon nanotube sheets due to electron-phonon interaction, respectively.

In light of the forgoing, monitoring the deflection of carbon nanotube tips provides an indication of the current-voltage response of the carbon nanotube array 4. As shown in FIG. 6(*a*), the initial and final positions of the carbon nanotubes in the pointed height distribution marked by the dashed lines and the red lines are substantially the same, indicating little to no deflection of carbon nanotube tips. In comparison, the initial and final positions of the carbon nanotubes in the random height distribution marked by the dashed and solid lines of FIG. 6(*b*) indicate substantially more deflections. Accordingly, the pointed height distribution provides an improved, stabilized current-voltage response over the random height distribution, indicating improved electron flow efficiencies over the random height distribution.

Figure 7A:
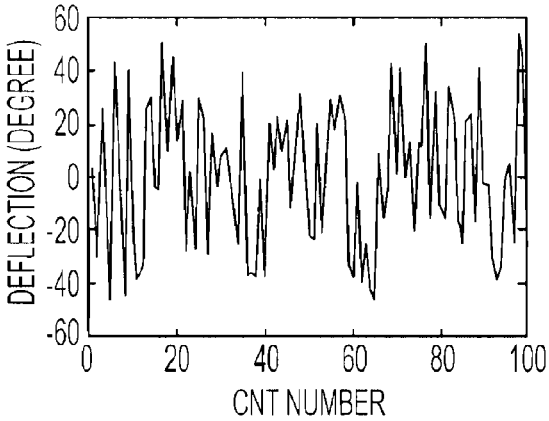
FIG. 7(*a*) is a plot illustrating simulated tip deflection angles of carbon nanotubes in an array of 100 carbon nanotubes at t=50 s of field emission for a height distribution according to an example embodiment of the disclosure.
Figure 7B:
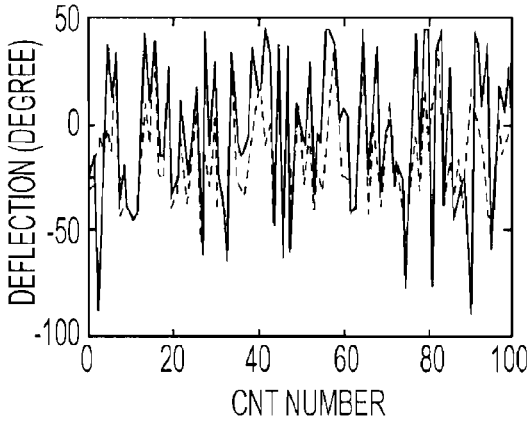

FIGS. 7(*a*) and 7(*b*) illustrate carbon nanotube deflection angles for a pointed height distribution and a random distribution, respectfully. Each distribution was provided with random initial deflection angles. The dashed lines illustrate an initial deflection angle and the red lines illustrate a final deflection angle after a time period of approximately 50 s.

The strong influence of lateral force field can be clearly seen in FIGS. 7(*a*) and 7(*b*). Such force field produces electrodynamic repulsion such that the resultant force imbalance on the carbon nanotubes toward the edges of the array eventually destabilizes the orientation of the carbon nanotube tips in FIG. 7(*b*). In the pointed height distribution arrangement of FIG. 7(*a*), this force imbalance is minimized due to gradual reduction in the carbon nanotube heights, and as a result, a lesser magnitude of deflections is observed. Also, the lateral electrodynamic forces produce instabilities in the randomly distributed array where the electrons are pulled up by the anode and the carbon nanotube tips experience a significant elongation as shown in FIG. 7(*b*).

Figure 8:
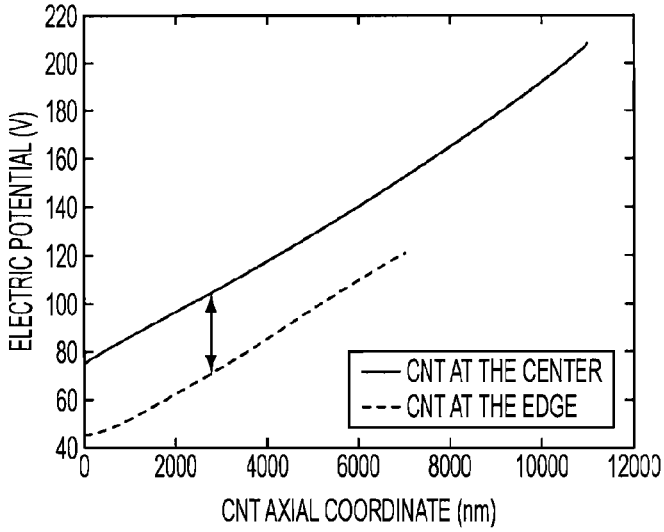
FIG. 8 is a plot illustrating the effect of a side gate on the electrical potential on the nanotubes near the edge of the array.

FIG. 8 illustrates a result of implementing a side-gate 12, including a comparison of electric potential along a nanotube 6 near the edge of the array 4 as compared to a nanotube 6 near the middle of the array 4. The arrow indicates a drop in the electric potential at the edge of the array 4, which is due to side gate alone. The drop in electric potential at the edge of the array due to the side-gate 12 helps to stabilize field emission and lateral deflection of nanotubes 6 at the edge of the array 4.

Figure 9A:
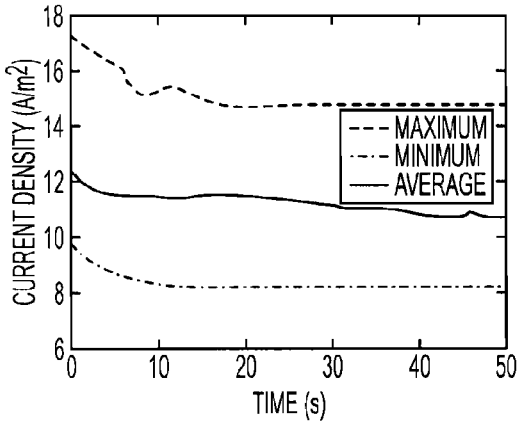
FIG. 9(*a*) is a plot illustrating simulated time history of field emission current density for an array of 100 CNTs at t=50 s of field emission for a pointed shape height distribution according to an embodiment of the disclosure.
Figure 9B:
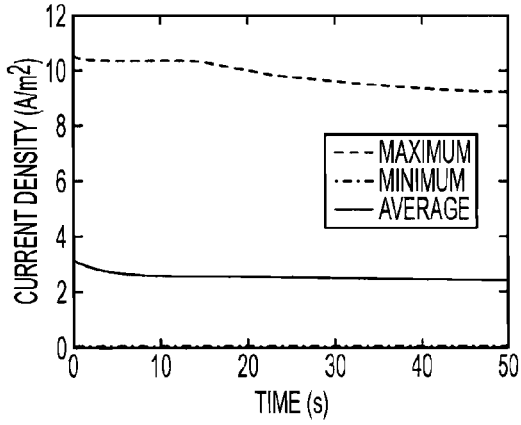

FIGS. 9(*a*) and 9(*b*) compare the time histories of maximum, minimum and average current densities out of the array for the case of a pointed height array and a random height array, respectively. As can be seen by comparing the average current density (solid line) of FIGS. 9(*a*) and 9(*b*), the average current density for the case of pointed height array is almost three times more than the average current density for the random height array. This result clearly demonstrates the improvement achieved by using a pointed height array 4 and a side gate 12. Beside a three fold increase in the magnitude of average current density for the pointed array case in FIG. 9(*a*), the temporal fluctuation is also insignificant as compared to FIG. 9(*b*), which indicates an improved field emission while maintaining high stability.

Figure 10:
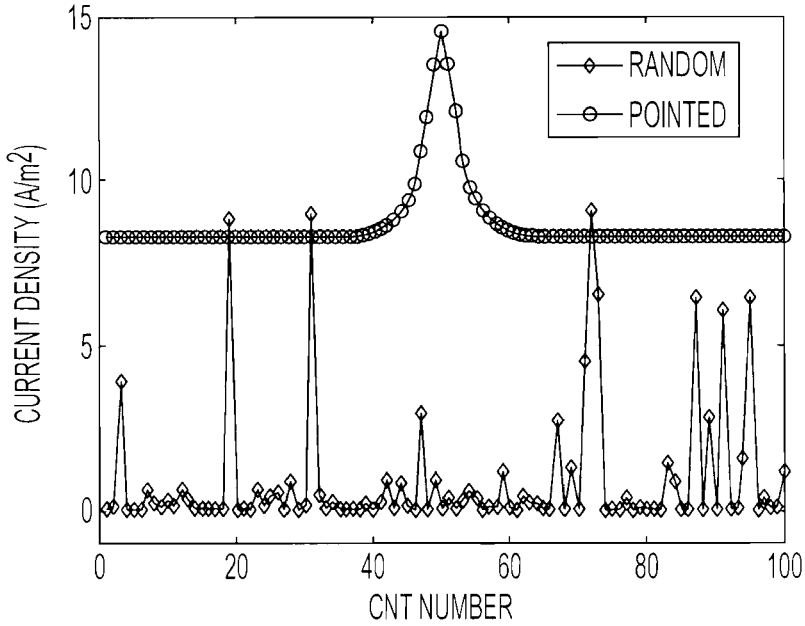
FIG. 10 is a plot illustrating simulated distribution of current density over the tips of the carbon nanotubes in both the pointed shape height distribution array and the random distribution array at t=50 s.

FIG. 10 demonstrates the spatial distribution of emission current density in the pointed height array as compared to the random distribution array. As shown in FIG. 10, the current density in the pointed height array shows a stable emission and a focus towards the middle of the array.

Figure 11A:
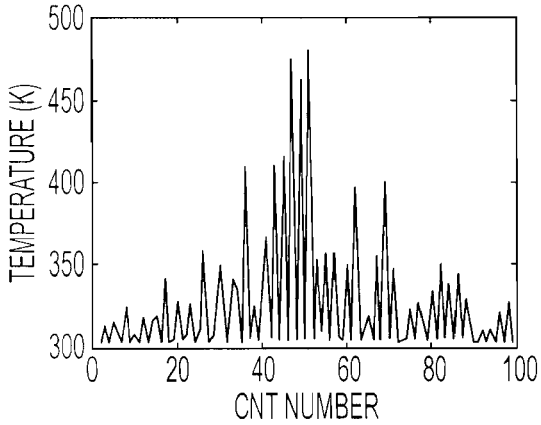
FIG. 11(*a*) is a plot illustrating simulated maximum temperatures at the tips of the carbon nanotubes for an array of 100 CNTs at t=50 s of field emission for a pointed shape height distribution according to an embodiment of the disclosure.
Figure 11B:
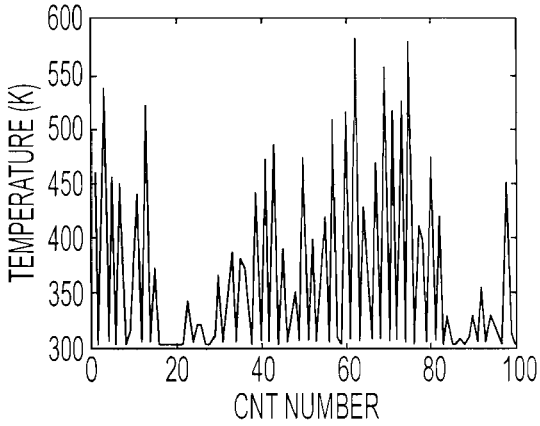

FIGS. 11(*a*) and 11(*b*) show the temperature at the tip of each carbon nanotube 6 over an array of 100 carbon nanotubes for the pointed height distribution array and the random distribution array, respectively. During the emission of the electrons, interactions among several quantum states and acoustic-thermal phonon modes take place. As the electrons become ballistic electrons in free space, the corresponding energy released to the carbon nanotube cap region by the ejected electrons produces thermal transients. FIG. 11(*a*) shows a temperature rise of up to approximately 480 K at the center of the pointed height distribution array. Additionally, the temperature distribution of the pointed height distribution array shows a more or less gradual decrease towards the edges. On the other hand, as seen in FIG. 11(*b*), the random height distribution array leads to a much stronger electron-phonon interaction as the carbon nanotubes undergo large tip rotations. As a result, the maximum temperature in the random distribution array is nearly 600K, and temperatures above 500K occur at several disparate points along the array.

As can be seen by the forgoing, by arranging the carbon nanotubes in a pointed height distribution array, and providing for a side-gate structure adjacent the array, for example, an improved x-ray generation source at the nano-scale can be provided.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds, compositions, or materials, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present.

For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations).

Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

As will be understood by one skilled in the art, for any and all purposes, such as in terms of providing a written description, all ranges disclosed herein also encompass any and all possible subranges and combinations of subranges thereof Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A field emission device comprising a cathode, the cathode comprised of a substrate and an array of carbon nanotubes arranged over the substrate in a variable height distribution, wherein the variable height distribution comprises a progression from an edge to a center of the distribution;

a segmented beam control mechanism formed over the substrate and comprised of a plurality of beam control segments for varying a trajectory of electrons emitted from the array of carbon nanotubes; and at least one side gate arranged below the segmented beam control mechanism and adjacent the array of carbon nanotubes in a partially overlapping manner such that at least a portion of the side gate exists in a same plane as at least a portion of the array of carbon nanotubes.

2. The device of claim 1, further comprising an insulating layer formed over the segmented beam control mechanism and an additional side gate for beam control formed over the insulating layer.

3. The device of claim 1, wherein the segmented beam control mechanism is disposed so as to be in a same or substantially proximate vertical plane as a maximum height of the array of carbon nanotubes.

4. The device of claim 1, further comprising control logic coupled to the segmented beam control mechanism for independently energizing each of the beam control segments.

5. The device of claim 1, wherein the variable height distribution progresses from the edge to the center of the distribution and wherein the variable height distribution comprises a peak height occurring in substantially a center of the array.

6. The device of claim 5, wherein the variable height distribution is symmetric over a center region of the array.

7. The device of claim 5, wherein the variable height distribution comprises a linear height progression from a circumferential position to a center portion of the array.

8. The device of claim 5, wherein the variable height distribution comprises a logarithmic height progression from a circumferential position to a center portion of the array.

9. The device of claim 5, wherein the variable height distribution comprises a parabolic height progression from a circumferential position to a center portion of the array.

10. The device of claim 1, wherein the at least one side gate circumferentially surrounds the array of carbon nanotubes.

11. The device of claim 1, further comprising an x-ray plate disposed over the cathode, array of carbon nanotubes, and segmented beam control mechanism, wherein the x-ray plate is comprised of a material that, when struck by electrons emitted from the array of carbon nanotubes, produces x-rays.

12. An imaging device comprising an array of pixels, each pixel including a field emission device, a segmented beam control mechanism, and at least one side gate arranged below the segmented beam control mechanism, wherein each field emission device comprising a cathode, the cathode comprising a substrate and an array of carbon nanotubes arranged over the substrate in a variable height distribution, wherein the variable height distribution comprises a progression from an edge to a center of the distribution;

wherein each segmented beam control mechanism is formed over the substrate and comprises a plurality of beam control segments for varying a trajectory of electrons emitted from the corresponding field emission device; and wherein each of the at least one side gate is adjacent to the array in a partially overlapping manner such that at least a portion of the at least one side gate exists in a same plane as at least a portion of the array of carbon nanotubes.

13. The imaging device of claim 12, wherein the pointed height distribution has a linear progression from an edge portion to a center portion, and wherein a peak height of the variable height distribution occurs in substantially a center of the array.

14. The imaging device of claim 12, further comprising an x-ray plate disposed in a field emission path of the array of pixels, wherein the x-ray plate is comprised of a material that, when struck by electrons emitted from the field emission devices, produces x-rays.

15. A field emission device comprising:

a cathode, the cathode comprised of a substrate and an array of carbon nanotubes arranged over the substrate in a variable height distribution wherein the variable height distribution is symmetric over a center region of the array and the array of carbon nanotubes has a peak height occurring in substantially a center of the array;

a side gate arranged adjacent the array in a partially overlapping manner wherein a portion of the side gate exists in a same plane as a portion of the array of carbon nanotubes; and a segmented beam control mechanism formed over the substrate and side gate and comprised of a plurality of beam control segments for varying a trajectory of electrons emitted from the array of carbon nanotubes.

* * * * *